US006785981B1

(12) United States Patent
Harpenau

(10) Patent No.: US 6,785,981 B1
(45) Date of Patent: Sep. 7, 2004

(54) RESTRICTION DETECTING SYSTEMS FOR CLOTHES DRYER EXHAUST SYSTEMS

(75) Inventor: Richard John Harpenau, Jupiter, FL (US)

(73) Assignee: In-O-Vate Technologies, Jupiter, FL (US)

( * ) Notice: Subject to any disclaimer, the term of this patent is extended or adjusted under 35 U.S.C. 154(b) by 0 days.

(21) Appl. No.: 10/369,805

(22) Filed: Feb. 19, 2003

(51) Int. Cl.[7] ..... F26B 11/02

(52) U.S. Cl. ..... 34/140; 34/602; 34/558; 454/340

(58) Field of Search ..... 34/595, 602, 603, 34/606, 140, 141, 550, 552, 558; 454/255, 339, 340

(56) References Cited

U.S. PATENT DOCUMENTS

| | | | | |
|---|---|---|---|---|
| 2,022,250 A | | 11/1935 | Lofgren | |
| 2,577,104 A | | 12/1951 | Butler | |
| 3,639,998 A | | 2/1972 | Mason | |
| 3,718,982 A | | 3/1973 | Deaton | |
| 3,990,069 A | * | 11/1976 | Schuman | 340/544 |
| 4,206,552 A | | 6/1980 | Pomerantz et al. | |
| 4,700,492 A | | 10/1987 | Werner et al. | |
| 4,899,462 A | | 2/1990 | Putnam et al. | |
| 5,154,008 A | * | 10/1992 | Chicot | 34/73 |
| 5,281,956 A | | 1/1994 | Bashark | |
| 5,325,809 A | | 7/1994 | Mulle, Jr. | |
| 5,378,254 A | | 1/1995 | Maly et al. | |
| 5,467,077 A | * | 11/1995 | Wunderlich et al. | 340/635 |
| 5,518,025 A | * | 5/1996 | Futa et al. | 137/468 |
| 5,675,908 A | | 10/1997 | Barnes | |
| 5,822,883 A | | 10/1998 | Horwitz | |
| 6,122,972 A | * | 9/2000 | Crider | 73/724 |
| 6,186,140 B1 | | 2/2001 | Hoague | |
| 6,220,092 B1 | | 4/2001 | Catbagan | |
| 6,328,647 B1 | | 12/2001 | Traudt | |

FOREIGN PATENT DOCUMENTS

EP 0245870 A1 11/1987

* cited by examiner

*Primary Examiner*—Ira S. Lazarus
*Assistant Examiner*—Kathryn S. O'Malley
(74) *Attorney, Agent, or Firm*—Akerman Senterfitt; Mark D. Passler; Michael K. Dixon

(57) ABSTRACT

A restriction sensor system for identifying the existence of blockages in exhaust conduits of clothes dryers. The restriction sensor system may include a pressure sensing device having a body configured to be coupled to an exhaust conduit of a clothes dryer. The pressure sensing device may be capable of determining changes in air pressure in the exhaust conduit. Once the air pressure present in the exhaust conduit exceeds a threshold air pressure, the pressure sensing device may send a signal to an indicator to generate an alarm, which may be a visual alarm or audible alarm, or both.

22 Claims, 5 Drawing Sheets

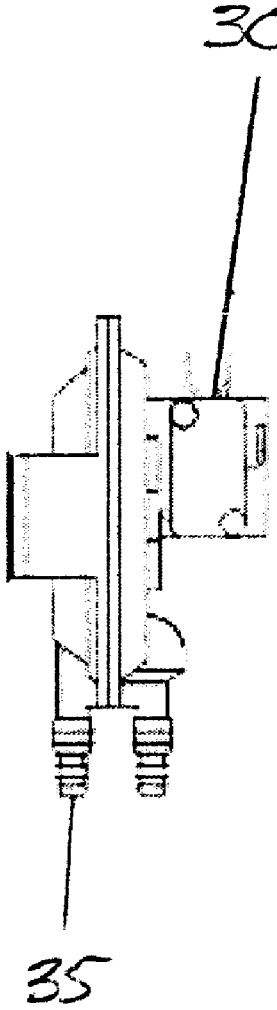
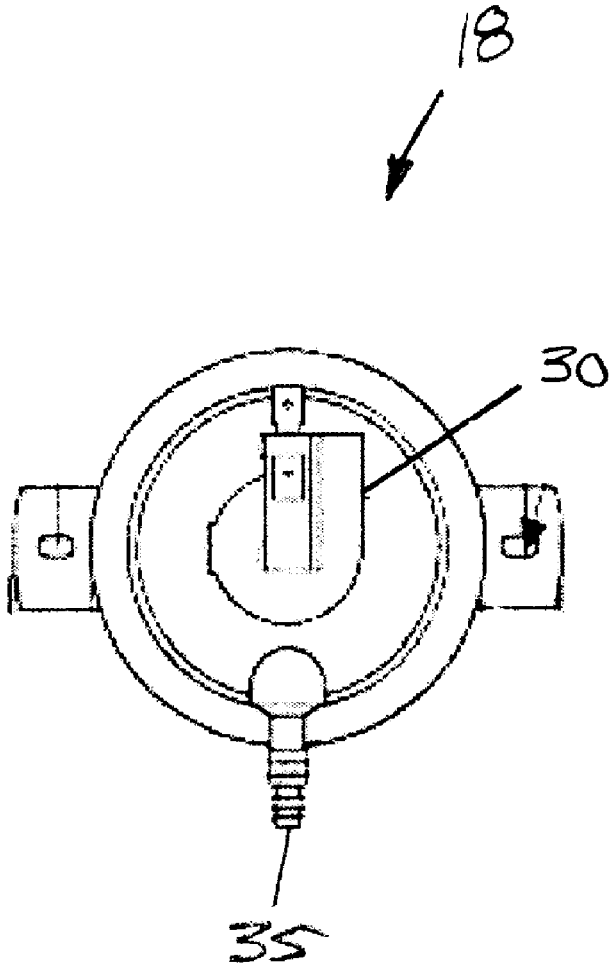
FIGURE 6
FIGURE 5

RESTRICTION DETECTING SYSTEMS FOR CLOTHES DRYER EXHAUST SYSTEMS

FIELD OF THE INVENTION

This invention is directed generally to clothes dryers, and more particularly, to safety systems for clothes dryers.

BACKGROUND

Conventional clothes dryers are constructed of a tumbler configured to hold clothes, a motor for rotating the tumbler, a heating element for heating air, a fan for blowing the heated air across the clothes while the clothes are in the tumbler, and an exhaust conduit for venting the heated air from the dryer. The heating element may be electric or gas powered. Because a close dryer includes a heating element, there always exists the chance of fire. Conventional clothes dryers include many different safety devices for reducing the likelihood of a fire. For instance, a conventional clothes dryer often includes a lint screen for removing lint from the air coming from a tumbler. The lint screen is often placed in an easily accessible location, such as in a slot in a top surface of the clothes dryer, and covers an exhaust conduit where the conduit leaves the tumbler. The lint screen collects lint from the air that has been picked up from the clothing in the tumbler. Most, if not all, manufacturers of clothes dryers recommend that lint screens be cleaned after each load of clothes is dried. Otherwise, an unacceptable amount of lint may build up on the lint screen and pose a fire hazard and prevent efficient operation.

Clothes dryers also typically contain heat sensors, such as thermocouples, for preventing dryers from overheating and causing fires. Most clothes dryers position a thermocouple proximate to a heating element of the clothes dryer. In this position, the thermocouple is capable of monitoring the area surrounding the heating element and can be used to determine whether the air surrounding the heating element is exceeding a predetermined threshold temperature. If the air becomes too hot, the thermocouple breaks a circuit, which thereby turns the dryer off and prevents the dryer from operating. The temperature of the air surrounding the heating element is monitored because the air surrounding the heating element often becomes too hot for safe operation when an exhaust conduit contains a blockage. Blockages in the exhaust conduits are dangerous because the blockages can cause the heating element to overheat and ignite lint near the heating element.

Many exhaust hoses for clothes dryers are incorrectly installed such that the exhaust hoses have internal diameters that are too small or are restrained. Such configurations accelerate lint collection on inside surfaces of the exhaust hoses, which may eventually result in partial or total blockage of the exhaust conduit. Such accumulation of lint may occur relatively quickly or over a longer period, such as a few years, and may go unnoticed by a homeowner. Such conditions are extremely dangerous.

While the conventional configuration of locating a thermocouple proximate to heating elements in a dryer has undoubtedly prevented many fires, dryers having this configuration remain susceptible to fires. In fact, dryers remain one of the most dangerous household appliances. Thus, a need exists for a system for improving the safety of clothes dryers.

SUMMARY OF THE INVENTION

This invention relates to a restriction sensor system usable with a clothes dryer for identifying blockages in an exhaust conduit downstream of a lint screen in an effort to prevent dangerous conditions and fires. The blockages may be found in the exhaust conduit located inside of or outside of a clothes dryer. The restriction sensor system may include a pressure sensing device for sensing the air pressure in an exhaust conduit of a clothes dryer downstream of a lint screen and creating an alert message when the air pressure on the exhaust conduit exceeds a pre-established threshold air pressure. The pressure sensing device may be formed from a body configured to be coupled to an exhaust conduit of a clothes dryer and may have at least one cavity for containing a diaphragm. The pressure sensing device may also include a diaphragm capable of reacting to relatively small changes in air pressure in the exhaust conduit. The pressure sensing device may also include a sensor for sensing the reactions of the diaphragm. In one embodiment, the sensor may be coupled to the diaphragm. The pressure sensing device may also include an orifice in the body for admitting a gas, such as air, from the exhaust conduit into the cavity of the pressure sensing device.

The restriction sensor system may also include one or more indicators for indicating that the pressure sensing device has identified that the air pressure in the exhaust conduit of the clothes dryer has exceeded a threshold air pressure. The indicator may be capable of generating a visual alert or an audible alert, or both. The indicator may be configured to be attached to a control panel of a clothes dryer or in another location on a clothes dryer.

BRIEF DESCRIPTION OF THE DRAWINGS

The accompanying drawings, which are incorporated in and form a part of the specification, illustrate embodiments of the presently disclosed invention and, together with the description, disclose the principles of the invention.

FIG. 5 is a side view of another embodiment of a pressure sensing device.

FIG. 6 is a top view of the pressure sensing device shown in FIG. 5.

DETAILED DESCRIPTION OF THE INVENTION

Figure 1:
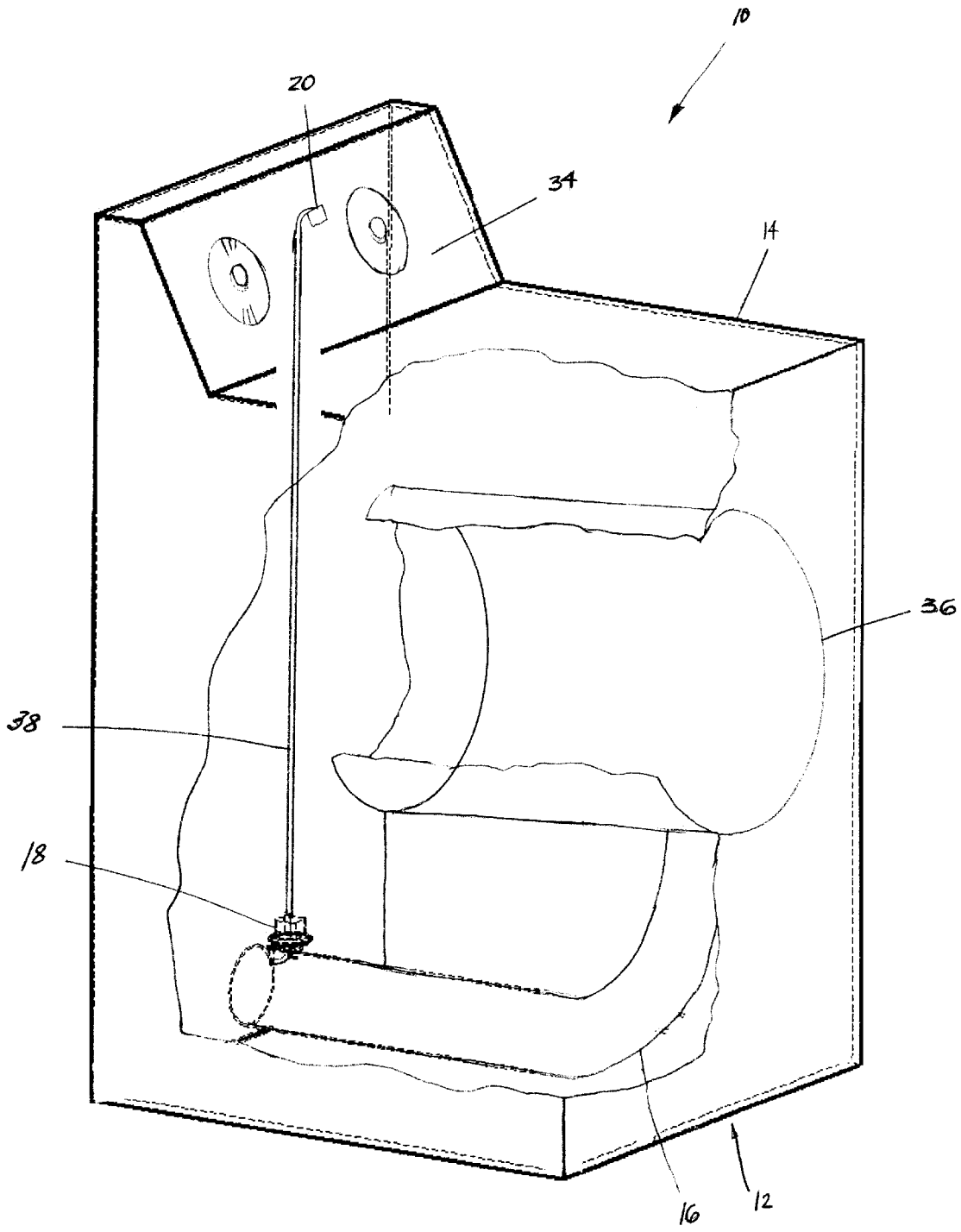
FIG. 1 is a perspective view with a partial cut away of a clothes dryer having a restriction sensor system.

As shown in FIGS. 1–4, this invention is a restriction sensor system 10 for use with an exhaust system 12 of a clothes dryer 14. Restriction sensor system 10 may be capable of determining whether an exhaust conduit 16 downstream of a lint screen contains a blockage, which could potentially cause unsafe conditions and lead to a fire. Exhaust conduit 16 may include portions of the exhaust system located inside of or outside of clothes dryer 14, or both. Restriction sensor system 10 may include a pressure sensing device 18 and an indicator 20 for indicating that pressure sensing device 18 has sensed an air pressure exceeding a threshold pressure in exhaust conduit 16 of clothes dryer 14.

Figure 3:
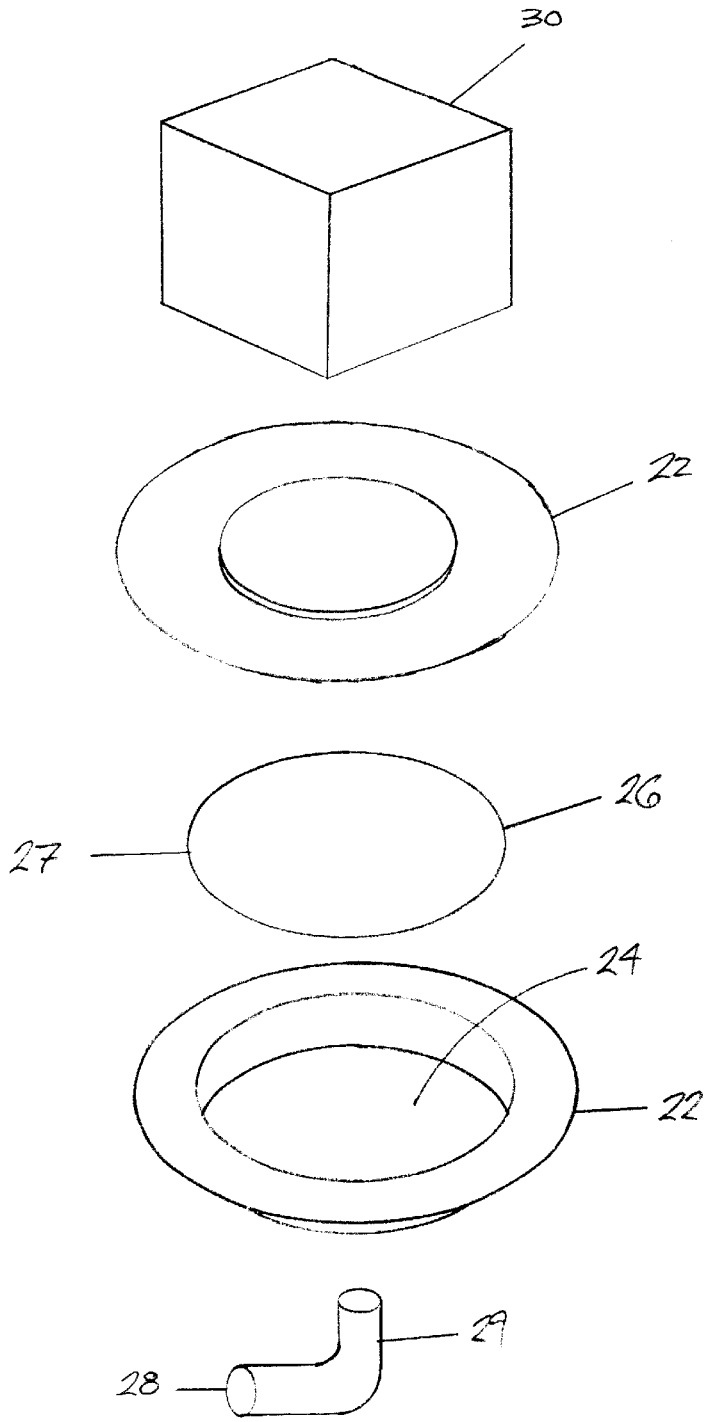
FIG. 3 is an exploded view of the pressure sensing device of FIG. 2.

Pressure sensing device 18 may be capable of determining whether the air pressure in exhaust conduit 16 has exceeded a threshold air pressure, which may indicate that a blockage exists. In one embodiment, pressure sensing device 18 may be a differential pressure monitoring device, as available from Veris Industries in Portland, Oreg. and shown in FIGS. 5 and 6. Exhaust conduit 16 is a conduit downstream of a lint screen, or if a dryer does not contain a lint screen, exhaust conduit 16 is a conduit extending from tumbler 36 to an exit port venting air from clothes dryer 14. Pressure sensing device 18 may be formed from a body 22 configured to fit into exhaust conduit 16. Body 22 may contain one or more cavities 24 for containing a diaphragm, as shown in FIG. 3. In at least one embodiment, a diaphragm 26 is positioned in cavity 24. Diaphragm 26 may be positioned so that a plane 27 in which diaphragm 26 rests is generally orthogonal to a general direction in which air is flowing and striking diaphragm 26. Diaphragm 26 may be a thin film capable of reacting to small changes in pressure.

Cavity 24 may be in communication with one or more orifices 28 in body 22. Orifice 28 may admit air found in exhaust conduit 16, into cavity 24. In another embodiment, orifice 28 may be coupled to a conduit 29 for admitting air found in exhaust conduit 16. Orifice 28 may have any size appropriate for admitting a gas into cavity 24. Orifice 28 is configured to inhibit contamination by lint or other debris. In one embodiment, orifice 28 and conduit 29 may form a pitot tube or static tube.

Body 22 may also have a sensor 30 coupled to diaphragm 26. Sensor 30 may be capable of sensing changes in position of diaphragm 26 that may be caused by changes in pressure in exhaust conduit 16. Sensor 30 may also be capable of measuring strain in diaphragm 26. Sensor 30 may be formed from solid-state feedback circuitry.

Figure 2:
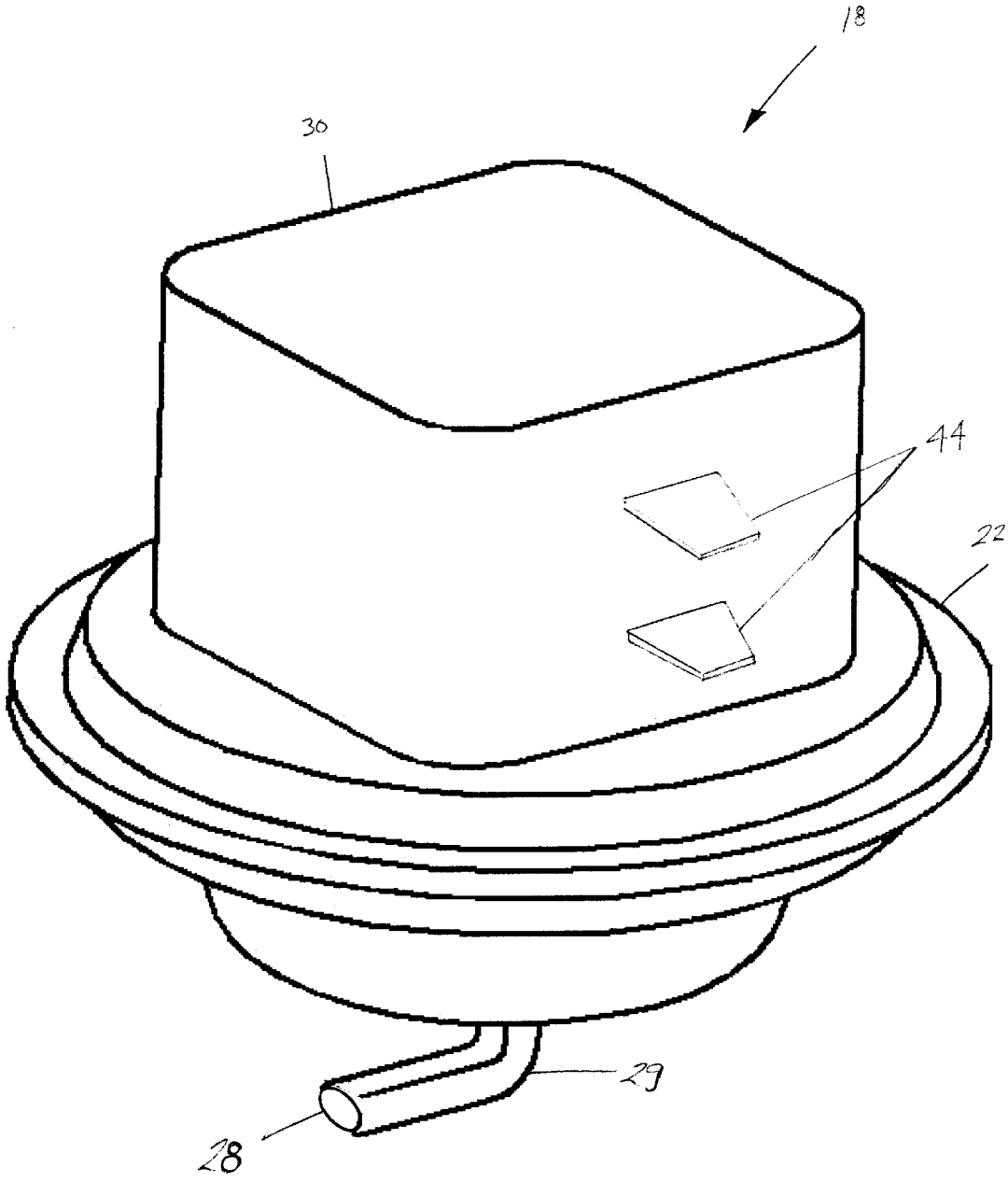
FIG. 2 is a perspective view of a pressure sensing device usable in the restriction sensor system of FIG. 1.
Figure 4:
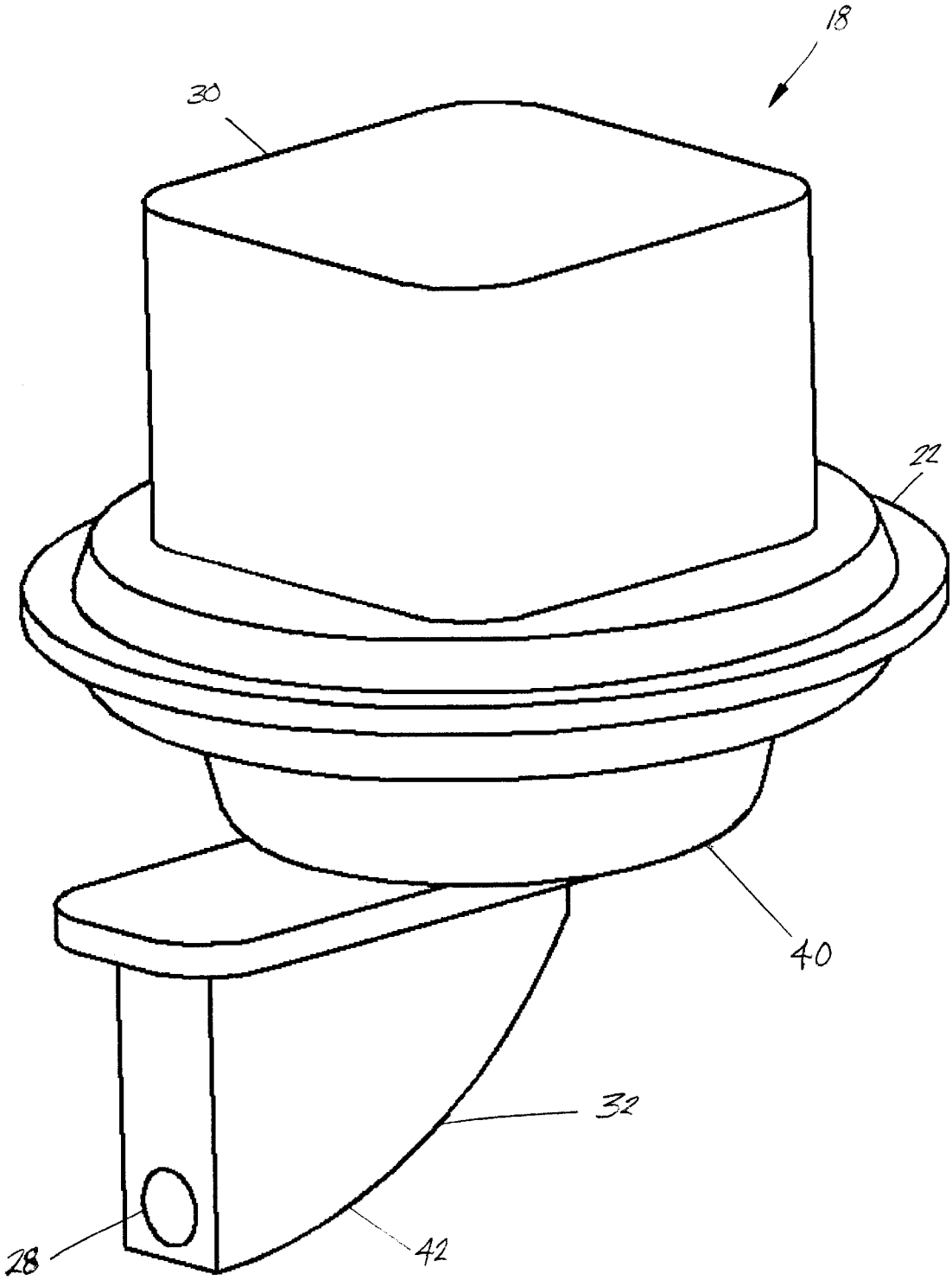
FIG. 4 is a perspective view of another embodiment of a pressure sensing device.

Body 22 may further include a fin 32, as shown in FIG. 4, housing orifice 28. Fin 32 may be coupled to a bottom side 40 of body 22. Fin 32 may be sized to accommodate orifice 28 and may have an aerodynamically efficient exterior surface. Fin 32 may include a curved edge 42 extending from the bottom side 40 of body 22 to orifice 28. In another embodiment, body 32 may not include fin 32, but instead include only conduit 29, as shown in FIG. 2. Conduit 29 may have any size appropriate for admitting air into cavity 24. In one embodiment, restriction sensor system 10 may be configured to position orifice 10 in exhaust conduit 16 so that orifice 28 faces downstream. However, this invention is not limited to positioning orifice 28 in this position. Rather, in another embodiment, restriction sensor system 10 may be positioned so that orifice 28 faces upstream.

Pressure sensing device 18 may include one or more indicators 20 for indicating that the exhaust conduit 16 has undergone an increase in air pressure that may be caused by, for instance and not by way of limitation, a blockage in exhaust conduit 16. Indicator 20 may emit a visual alert or an audible alert, or both. Indicator 20 may be a light emitting device (LED) or other visually alerting device. Indicator 20 may also be a speaker, buzzer, or other noise making device. Indicator 20 may be configured to be attached to a control panel 34 of clothes dryer 14. Indicator 20 may be coupled to sensor 30 using one or more electricity conducting wires 38. Wires 38 may be connected to connectors 44.

In another embodiment, restriction sensor system 10 may include pressure sensing device 18 including diaphragm 26, as shown in FIGS. 5 and 6, that is configured to be coupled to exhaust conduit 16 of clothes dryer 14 using a conduit rather than coupling the pressure sensing device 18 directly to exhaust conduit 16. Diaphragm 26 may be a diaphragm having model number RSS-495 that is available from Cleveland Controls of Cleveland, Ohio. The conduit may be coupled to diaphragm 26 at an inlet 35 using connection mechanisms such as, but not limited to, barbs and other devices. The conduit may be mounted directly to a port in exhaust conduit 16. Alternatively, the conduit may be mounted a device or have an end with a fin 32. In this embodiment, restriction sensor system 10 may also include sensor 30 in communication with diaphragm 26 and one or more indicators 20 for indicating the pressure in exhaust conduit 16 of clothes dryer 14. Sensor 30 may be, but is not limited to, a snap-acting switch.

Restriction sensor system 10 is capable of being installed on any clothes dryer with little modification during a manufacturing process or after a clothes dryer has been completely assembled. The clothes dryer may have a tumbler 36 for containing clothes, a heating element for heating air, a fan for blowing air across the clothes in tumbler 36, an exhaust conduit 16 for removing heated air, a control panel 34, and a motor for rotating tumbler 36. Pressure sensing device 18 may be coupled to exhaust conduit 16 downstream of either a lint screen, or if the clothes dryer does not have a lint screen, down stream of the point at which exhaust conduit 16 couples to tumbler 36.

During operation of clothes dryer 14, lint and other debris is collected with a lint screen. However, lint and other debris often pass through the lint screen and collects in exhaust conduit 16. Accumulation of lint and other debris in exhaust conduit 16 is a fire hazard. When clothes dryer 14 is operating, air pressure develops in exhaust conduit 16. As debris collects in clothes dryer 14, the air pressure in exhaust conduit 16 increases. As the air pressure increases, diaphragm 26 reacts to the change in air pressure. Sensor 30 senses the reaction of diaphragm 26. When the air pressure in exhaust conduit 16 exceeds a threshold pressure, sensor 30 causes indicator 20 to indicate that exhaust conduit 16 exceeds the threshold pressure. An increase in air pressure in the exhaust system of a clothes dryer may be caused by an increase in lint accumulation.

Indicator 20 may indicate that an air pressure in excess of a threshold air pressure has been observed by producing a blinking light, a light that is continuously turned on, a noise, such as, but not limited to, a buzzer, a voice that may give instructions on how to check the exhaust conduit, or others. In one embodiment, after sensor 30 determines that a threshold air pressure has been exceeded, indicator 20 remains actuated at all times when clothes dryer 14 is in use until the air pressure subsides to a level beneath the threshold air pressure. The threshold air pressure will vary depending on numerous factors, such as, but not limited to, the diameter of exhaust conduit 16, the length of exhaust conduit 16, the presence or absence of a cover on the end of exhaust conduit 16 and other factors. As a result, the threshold air pressure may vary.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. An air pressure sensing system for a clothes dryer, comprising:

a pressure sensing device, comprising:

a body coupled to an exhaust conduit of a clothes dryer downstream of a lint screen and having at least one cavity for containing a diaphragm;

a diaphragm positioned in the body for reacting to changes in air pressure in the exhaust conduit;

a sensor coupled to the diaphragm for sensing reactions of the diaphragm; and an orifice in the body for admitting air; and an indicator coupled to the sensor of the pressure sensing device for indicating that the pressure sensing device has sensed air pressure exceeding a threshold air pressure in the exhaust conduit.

2. The air pressure sensing system of claim 1, wherein the indicator is configured to be coupled to a display surface of a clothes dryer.

3. The air pressure sensing system of claim 1, wherein the indicator is capable of emitting a visual signal.

4. The air pressure sensing system of claim 3, wherein the indicator is a light emitting diode.

5. The air pressure sensing system of claim 1, wherein the indicator is capable of emitting a noise indicating that the exhaust conduit of the clothes dryer has an air pressure greater than a threshold air pressure.

6. The air pressure sensing system of claim 5, wherein the indicator comprises a buzzer.

7. The air pressure sensing system of claim 5, wherein the indicator comprises a speaker.

8. The air pressure sensing system of claim 1, wherein the orifice is positioned in the body so that the orifice is capable of facing downstream when the body is coupled to an exhaust conduit, thereby limiting the contamination of the orifice with lint.

9. The air pressure sensing system of claim 1, wherein the body further comprises a fin for reducing drag proximate to the orifice and preventing the accumulation of lint.

10. The air pressure sensing system of claim 9, wherein the fin includes a curved edge configured to face the direction of fluid flow through the exhaust conduit for preventing the accumulation of lint.

11. The air pressure sensing system of claim 1, wherein the indicator is coupled to the diaphragm using electricity conducting wires.

12. The air pressure sensing system of claim 1, wherein the pressure sensing device comprises a differential pressure monitoring device.

13. A clothes dryer, comprising:

a tumbler capable of containing at least one piece of clothing;

an exhaust conduit in communication with the tumbler for removing air from the tumbler;

a pressure sensing device, comprising:

a body coupled to the exhaust conduit of the clothes dryer downstream of a lint screen and having at least one cavity for containing a diaphragm;

a diaphragm positioned in the body for reacting to changes in air pressure in the exhaust conduit;

a sensor coupled to the diaphragm for sensing reactions of the diaphragm; and an orifice in the body for admitting air; and an indicator coupled to the sensor of the pressure sensing device for indicating that the pressure sensing device has sensed an air pressure exceeding a threshold air pressure in the exhaust conduit.

14. The clothes dryer of claim 13, further comprising a control panel and wherein the indicator is coupled to the control panel of the clothes dryer.

15. The clothes dryer of claim 13, wherein the indicator is capable of emitting a visual signal.

16. The clothes dryer of claim 15, wherein the indicator is a light emitting diode.

17. The clothes dryer of claim 13, wherein the indicator is capable of emitting a noise indicating that the exhaust conduit of the clothes dryer has an air pressure greater than a threshold air pressure.

18. The clothes dryer of claim 17, wherein the indicator comprises a buzzer.

19. The clothes dryer of claim 18, wherein the indicator comprises a speaker.

20. The clothes dryer of claim 13, wherein the orifice is positioned in the exhaust conduit to face downstream.

21. The clothes dryer of claim 13, wherein the body further comprises a fin for reducing drag proximate to the orifice.

22. An air pressure sensing system for a clothes dryer, comprising:

a pressure sensing device for sensing changes in air pressure in an exhaust conduit;

at least one conduit coupled to the pressure sensing device and coupled to an exhaust conduit of the clothes dryer downstream of a lint screen;

a sensor coupled to the pressure sensing device for sensing reactions of the pressure sensing device; and an indicator coupled to the sensor for indicating that the pressure sensing device has sensed air pressure exceeding a threshold air pressure in the exhaust conduit and for identifying the existence of a blockage in the exhaust conduit.

* * * * *